US005278573A

United States Patent [19]

Siikarla

[11] Patent Number: 5,278,573

[45] Date of Patent: Jan. 11, 1994

[54] ELECTRONIC ARTICLE SURVEILLANCE SYSTEM AND TAG CIRCUIT COMPONENTS THEREFOR

[75] Inventor: Risto Siikarla, Boca Raton, Fla.

[73] Assignee: Sensormatic Electronics Corporation, Deerfield Beach, Fla.

[21] Appl. No.: 562,749

[22] Filed: Aug. 6, 1990

[51] Int. Cl.[5] ..... H01Q 9/00

[52] U.S. Cl. ..... 343/749; 343/895; 340/572

[58] Field of Search ..... 343/749, 595, 700; 340/570, 572, 571; H01Q 9/00

[56] References Cited

U.S. PATENT DOCUMENTS

| | | | |
|---|---|---|---|
| 3,103,011 | 9/1963 | Seeley | 343/749 |
| 3,984,838 | 10/1976 | Voronoff | 343/742 |
| 4,413,254 | 11/1983 | Pinneo et al. | 340/572 |
| 4,642,640 | 2/1987 | Woolsey et al. | 340/572 |
| 4,736,207 | 4/1988 | Siikarla et al. | 343/700 MS |
| 4,800,395 | 1/1989 | Balzano et al. | 343/749 |
| 4,827,266 | 5/1989 | Sato et al. | 343/749 |
| 5,030,940 | 7/1991 | Siikarla | 340/572 |

*Primary Examiner*—Donald Hajec
*Assistant Examiner*—Hoanganh Le
*Attorney, Agent, or Firm*—Robin, Blecker, Daley & Driscoll

[57] ABSTRACT

An electronic article surveillance tag comprises a reradiator element, a nonlinear element connected electrically to the reradiator element, and an electrical ground plane member connected electrically to the nonlinear element. The reradiator element, the nonlinear element and the ground plane member are in electrical series circuit connection. The reradiator element and the ground plane member define a monopole antenna upon incidence on the tag of high frequency energy for reradiation of the high frequency energy and further define a dipole antenna upon incidence on the tag of energy of frequency substantially lower than the high frequency energy. An electronic article surveillance system in accordance with the invention comprises a transmitter-receiver arrangement disposed aside an area to be controlled for transmitting a first high-frequency signal into the area, a transmitter disposed aside the area and generating a second frequency signal of substantially lower frequency than the first frequency for establishing in the area an electrostatic field, a tag for attachment to an article to be subject to surveillance, the tag being responsive to the incidence thereon of energy of both the first and second frequencies to transmit a composite thereof and receiver apparatus disposed aside the area for receipt and detection of such composite signal and for generation of an output signal indicative of such detection.

23 Claims, 2 Drawing Sheets

ELECTRONIC ARTICLE SURVEILLANCE SYSTEM AND TAG CIRCUIT COMPONENTS THEREFOR

FIELD OF THE INVENTION

This invention relates to the field of electronic article surveillance (EAS) and pertains more particularly to improved EAS systems and to improved tags or markers for EAS systems and practices.

BACKGROUND OF THE INVENTION

In an electronic article surveillance (EAS) system of known type, a transmitter-receiver arrangement is disposed aside an area to be controlled and transmits a first, high-frequency, signal into the area. A separate transmitter furnishes a second signal of substantially lower frequency (commonly referred to as the E-field or electrostatic field signal). Reradiators, typically comprising a dipole and a nonlinear element, are responsive to the incidence thereon of both transmitted signals to transmit a composite thereof and detection of such composite signal in receiving apparatus indicates the presence of the reradiator (security tag) in the controlled area. Such system is further described in U.S. Pat. Nos. 3,895,368 and 4,139,844, commonly-assigned herewith and incorporated herein by this reference.

The reradiator is incorporated in parent structure customarily referred to as an EAS tag or marker. There is a continued need to reduce the size of such tags. The fundamental problem in producing a small tag flows from the frequencies used in the above-described EAS system, especially the high frequency, which is in the microwave band, e.g., 915 MHz. Tags are most practical when made near one-half wave long, which is approximately 6.5 inches at 915 MHz. Making a tag shorter than such half-wavelength causes it to become electrically too short. The resulting capacitive reactance, combined with the capacitive source impedance of a diode, makes such designs complicated as impedance matching becomes very critical.

Existing solutions use a combination of narrow and wide foil areas or make use of diode leads to overcome capacitive reactances. These methods require much space and either make the tags long, or when tag elements are folded back to reduce length, will make them wide.

One prior art effort is set forth in U.S. Pat. No. 4,642,640, commonly-assigned herewith and to which incorporating reference is hereby made. In the '640 patent, a narrow serpentine foil section is used for impedance matching. The principle underlying the reradiator element of this patent is that of an non-symmetrical dipole, which is folded back to conserve length.

A second prior art effort is set forth in U.S. Pat. No. 4,736,207, commonly-assigned herewith and to which incorporating reference is hereby made. In the '207 patent, the impedance matching is again achieved by narrow foil sections along the edge of the tag. In this case, the narrow sections also form part of the reradiating RF element of a symmetrical dipole principle. Again, as in the '640 patent, part of the pattern is folded back to conserve space.

From the foregoing, it will be understood that the EAS industry would evidently be aided and abetted by tags which are effective in respect of detectability with reduced lengths and widths.

SUMMARY OF THE INVENTION

The present invention has as its primary object the provision of EAS tags which overcome the described size disadvantages of the prior art.

In attaining this and other objects, the invention provides a tag which incorporates a reradiator which is configured as a monopole. A monopole antenna typically requires only half as much length as a dipole and encompasses a ground plane to that effect. In customary monopole configurations, the ground plane is required to be perpendicular to the reradiator element of the monopole and of considerable size. This is because monopole reradiator elements are of length normally near one-quarter wavelength and operate at or close to their natural resonance. Per the present invention, however, the reradiator element has considerable inductive reactance and a large ground plane is neither required nor desirable. The resonant matching condition thus is controlled by impedances of the components of the reradiator, such as, a diode and a spiral reradiator element.

In the preferred embodiment of the invention, a tag uses a reradiator element which comprises a spirally wound inductor, which can be both very short and narrow without much loss of efficiency. The ground plane used is a reasonably narrow and short strip of conductive material and is placed in line with the spiral element. By choosing a diode with suitable impedance characteristics, the limited size of the in-line ground plane can be made an integral part of the overall impedance matching system.

A significant and valuable feature of this invention is that all of the components are short, to conserve length, and narrow, to conserve width. Thus, a very compact tag design is achieved in accordance with the invention with performance comparable with existing larger tags.

An electronic article surveillance system in accordance with the invention comprises a transmitter-receiver arrangement disposed aside an area to be controlled for transmitting a first high-frequency signal into the area, a transmitter disposed aside the area and generating a second frequency signal of substantially lower frequency than the first frequency for establishing in the area an electrostatic field, a tag for attachment to an article to be subject to surveillance, the tag being responsive to the incidence thereon of energy of both the first and second frequencies to transmit a composite thereof and receiver apparatus disposed aside the area for receipt and detection of such composite signal and for generation of an output signal indicative of such detection, the tag comprising a reradiator element, a nonlinear element connected electrically to the reradiator element and an electrical ground plane member connected electrically to the nonlinear element, The reradiator element, the nonlinear element and the ground plane member are in electrical series circuit connection, the reradiator element and the ground plane member defining a monopole antenna for receipt and reradiation of the first signal and further defining a dipole antenna upon incidence on the tag of energy of the second frequency.

The foregoing and other objects and features of the invention will be further understood from the following detailed description of a preferred embodiment thereof and from the drawings wherein like reference numerals identify like components and parts throughout.

DETAILED DESCRIPTION OF THE PREFERRED EMBODIMENTS

Figure 2:
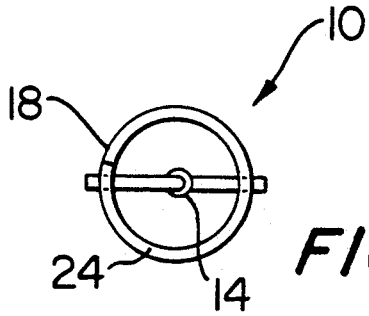
FIG. 2 is a top plan elevation of the FIG. 1 reradiator.
Figure 1:
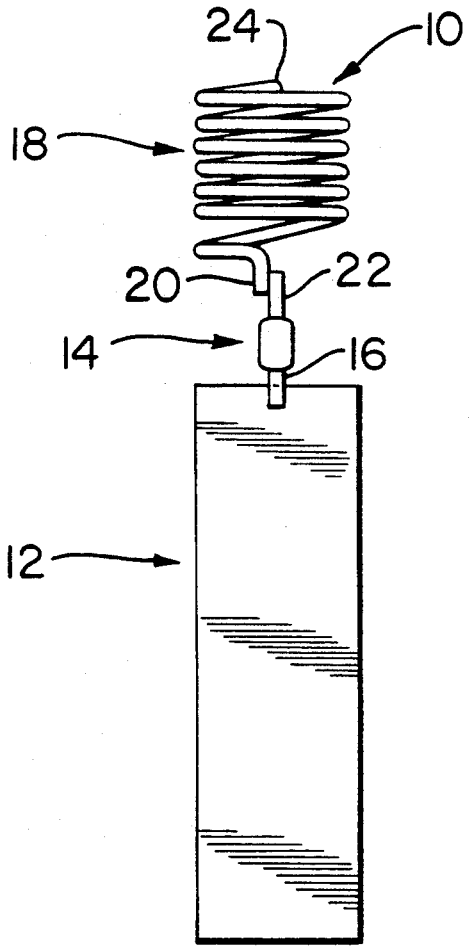
FIG. 1 is a front plan elevation of a reradiator constructed in accordance with the invention.
Figure 3:
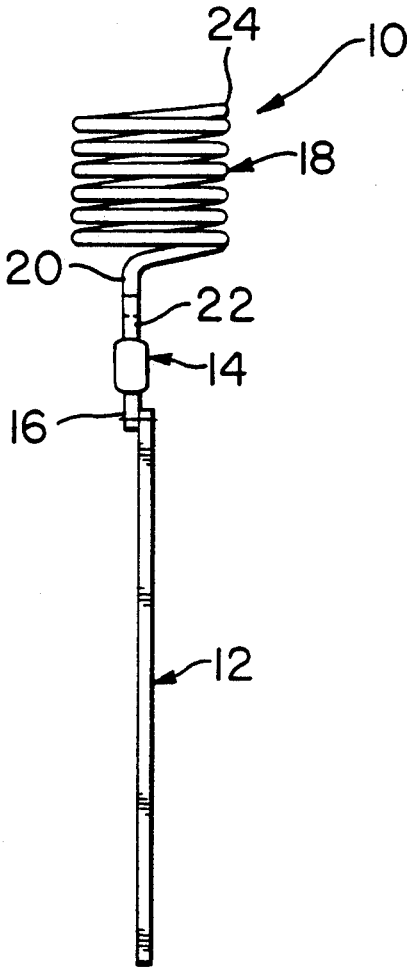
FIG. 3 is a right side elevation of the FIG. 1 reradiator.

Referring to FIGS. 1–3, reradiator 10 of the invention includes an elongate, generally planar and electrically conductive member 12, constituting the ground plane of the reradiator.

A nonlinear element 14, typically a diode, has one lead 16 thereof connected electrically, as by solder, to ground plane 12 adjacent an end thereof.

Reradiator element 18 has one end 20 thereof electrically connected to a second lead 22 of diode 14 and its other end 24 is without electrical connection thereto.

Ground plane 12 is typically a rectangular section of a conductive sheet, the dimensions of which are selected to minimize the overall size of the tag, yet maintaining the minimum required performance in a particular application. The optimum width to minimize the overall tag size is the same as the outside diameter of the spiral reradiator element.

Diode 14 is preferably a semiconductor diode, having high and low frequency characteristics selected desirably as described in the referenced '207 patent.

Reradiator element 18 is preferably a spiral inductor of dimensions selected to optimize the impedance match to cumulative impedance conditions presented by the inductor to the other two components, all such three components being connected electrically as a series circuit.

The function of reradiator element 18 is three-fold, namely, to receive and transmit high frequency energy, to serve as one side of an elementary dipole to capture low frequency electrostatic energy, typically 100 kHz, and to provide impedance matching at high frequency among the three components connected in series.

The function of diode 14 is that disclosed in the '207 patent, namely, to generate high frequency sidebands through reactance-modulation by applied low frequency electrostatic energy.

The function of ground plane 12 is two-fold, namely, to serve as the ground against which reradiator element 18 forms a monopole antenna and to serve as the second part of a dipole for low frequency electrostatic energy, as in the prior art endeavors described above.

Figure 4:
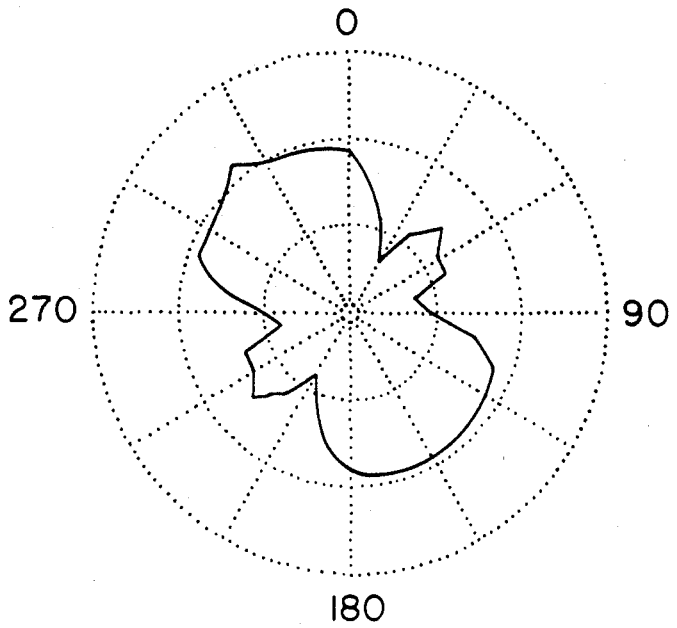
FIG. 4 is a polar plot of the performance characteristics of a prior art reradiator.
Figure 5:
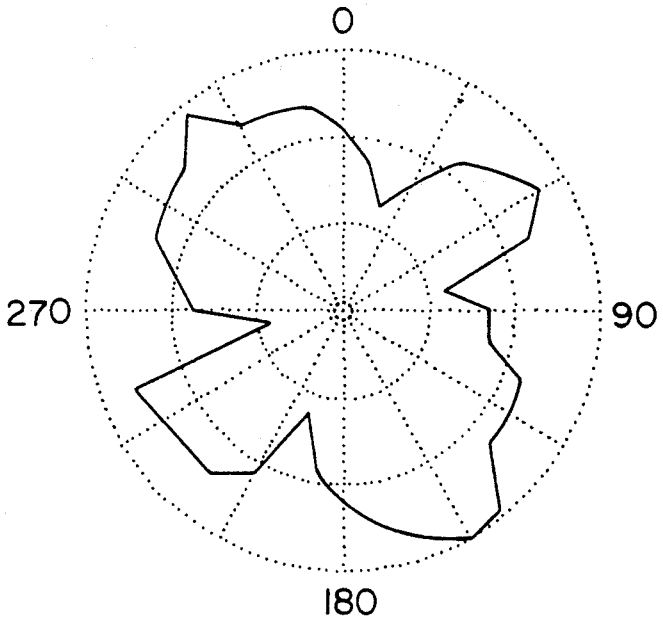
FIG. 5 is a polar plot of the performance characteristics of a reradiator constructed in accordance with the invention.

Reference is now made to the plots of FIGS. 4 and 5. An evaluation method involves polar plotting of the distance at which a tag response (reradiation) is sensed with respect to a source transmitting-receiving location. The graphics programs show the response in the form of a polar diagram, where each circle represents a distance of ten inches. The full scale is of thirty inches and plots the response at 10 degree increments and computes a total for the readings, from which it computes an estimated pick rate. Computation is based on tag performance in a reference system installation used for correlation between standard test results and actual system pick rate.

For comparison, a standard assignee product, the EL90 Microgator tag, is measured. The sample is verified to meet the quality standards for the product.

FIG. 4 shows the response of the reference tag EL90, and FIG. 5 presents the results obtained from a tag constructed as in the case of FIGS. 1–3. Estimated performance improvement of thirty-two percent is seen as being obtained by the invention, despite the smaller size of the tag of the invention. The EL90 tag dimensions are 0.75" wide and 2.45" long, or 1.84 square inches of cross section area. The sample of the invention disclosed here measured 0.375" wide and 1.8" long, which equals 0.675 square inch total area, or a sixty-three percent reduction in size.

Figure 6:
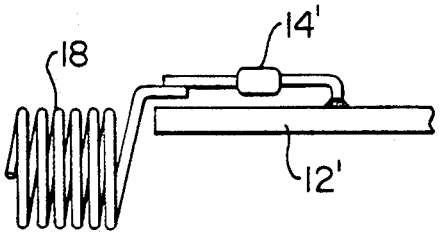
FIG. 6 is a side elevation of a second embodiment of a reradiator in accordance with the invention.

Turning to FIG. 6, a second embodiment of the invention will be seen to obtain further foreshortening of the length of the reradiator assembly. Thus, whereas in the embodiment of FIGS. 1–3, the diode was not in location co-registration with the ground plane, the arrangement of FIG. 6 depicts locational registry of the diode and the ground plane. Diode 14' is seen to be in confronting relation with ground plane 12', with reradiator element 18 being longitudinally successive to both of the diode and the ground plane.

Various changes to structure may be introduced in the foregoing embodiments and practices without departing from the invention. Thus, the particularly discussed and depicted embodiments are intended in an illustrative and not in a limiting sense. The true spirit and scope of the invention is set forth in the following claims.

What is claimed is:

1. In combination, in an electronic article surveillance tag, tag circuit components, comprising:

(a) a reradiator element;

(b) a nonlinear element connected electrically to said reradiator element; and (c) an electrical ground plane member connected electrically to said nonlinear element, said reradiator element, said nonlinear element and said ground plane member being in electrical series circuit connection, said reradiator element and said ground plane member being configured to define a monopole antenna upon incidence on said tag circuit components of a high frequency energy for reradiation of said high frequency energy.

2. The invention claimed in claim 1 wherein said reradiator element and said ground plane member further are configured to define a dipole antenna upon incidence on said tag circuit components of energy of frequency substantially lower than said high frequency energy.

3. The invention claimed in claim 2 wherein said reradiator element and said ground plane member are adapted to concurrently define said monopole and dipole antennas.

4. The invention claimed in claim 1 wherein said nonlinear element is adapted to generate high frequency sidebands through reactance-modulation by such lower frequency energy.

5. The invention claimed in claim 1 wherein said ground plane member exhibits a dimension substantially equal to a dimension exhibited by said reradiator element.

6. The invention claimed in claim 1 wherein said reradiator element comprises a spiral inductor.

7. The invention claimed in claim 6 wherein said ground plane member is elongate and has a width dimension substantially equal to the outside diameter of said spiral inductor.

8. The invention claimed in claim 6 wherein said spiral inductor is of dimensions selected to effect an impedance match to cumulative impedance conditions presented by the inductor to said nonlinear element and said ground plane.

9. The invention claimed in claim 1 wherein said tag circuit components are elongate, said reradiator element having a central axis longitudinally disposed with said tag circuit components, said nonlinear element and said ground plane member being disposed in general alignment with said central axis.

10. The invention claimed in claim 1 wherein said tag circuit components are elongate, said reradiator element having a central axis longitudinally disposed with said tag circuit components, said nonlinear element and said ground plane member being disposed with at least respective parts thereof in mutual registry longitudinally of said tag circuit components.

11. The invention claimed in claim 1 wherein said nonlinear element is a diode.

12. The invention claimed in claim 1 wherein said ground plane member is a conductive sheet.

13. An electronic article surveillance system comprising a transmitter-receiver arrangement disposed aside an area to be controlled for transmitting a first high-frequency signal into said area, a transmitter disposed aside said area and generating a second frequency signal of substantially lower frequency than said first frequency for establishing in said area an electrostatic field, tag circuit components for attachment to an article to be subject to surveillance, said tag circuit components being responsive to the incidence thereon of energy of both said first and second frequencies to transmit a composite thereof and receiver apparatus disposed aside said area for receipt and detection of such composite signal and for generation of an output signal indicative of such detection, said tag circuit components comprising:

(a) a reradiator element;

(b) a nonlinear element connected electrically to said reradiator element; and (c) an electrical ground plane member connected electrically to said nonlinear element, said reradiator element, said nonlinear element and said ground plane member being in electrical series circuit connection, said reradiator element and said ground plane member being configured to define a monopole antenna for receipt and reradiation of said first signal and further being configured to define a dipole antenna upon incidence on said tag circuit components of energy of said second frequency.

14. The invention claimed in claim 13 wherein said nonlinear element is adapted to generate high frequency sidebands through reactance-modulation by such lower frequency energy.

15. The invention claimed in claim 13 wherein said reradiator element and said ground plane member are adapted to concurrently define said monopole and dipole antennas.

16. The invention claimed in claim 13 wherein said ground plane member exhibits a dimension substantially equal to a dimension exhibited by said reradiator element.

17. The invention claimed in claim 13 wherein said reradiator element comprises a spiral inductor.

18. The invention claimed in claim 17 wherein said ground plane member is elongate and has a width dimension substantially equal to the outside diameter of said spiral inductor.

19. The invention claimed in claim 17 wherein said spiral inductor is of dimensions selected to effect an impedance match to cumulative impedance conditions presented by the inductor to the said nonlinear element and said ground plane.

20. The invention claimed in claim 13 wherein said tag circuit components are elongate, said reradiator having a central-axis longitudinally disposed with said tag circuit components, said nonlinear element and said ground plane member being disposed in general alignment with said central axis.

21. The invention claimed in claim 13 wherein said tag circuit components are elongate, said reradiator element having a central axis longitudinally disposed with said tag circuit components, said nonlinear element and said ground plane member being disposed with at least respective parts thereof in mutual registry longitudinally of said tag circuit components.

22. The invention claimed in claim 13 wherein said nonlinear element is a diode.

23. The invention claimed in claim 13 wherein said ground plane member is a conductive sheet.

* * * * *